United States Patent [19]

Coleman

[11] Patent Number: 4,951,752

[45] Date of Patent: Aug. 28, 1990

[54] STANDING VALVE

[75] Inventor: Steven B. Coleman, Corpus Christi, Tex.

[73] Assignee: Exxon Production Research Company, Houston, Tex.

[21] Appl. No.: 340,998

[22] Filed: Apr. 20, 1989

[51] Int. Cl.[5] ..... E21B 34/10

[52] U.S. Cl. ..... 166/325; 166/332; 166/373

[58] Field of Search ..... 166/372, 373, 188, 325, 166/332

[56] References Cited

U.S. PATENT DOCUMENTS

| | | | |
|---|---|---|---|
| 248,637 | 10/1881 | Crowley . | |
| 1,844,074 | 2/1932 | Ricker . | |
| 1,927,081 | 9/1933 | Bryan . | |
| 2,071,639 | 2/1937 | Long . | |
| 3,888,273 | 6/1975 | Douglas | 137/155 |
| 3,970,145 | 7/1976 | Boyd | 166/188 |
| 4,352,366 | 10/1982 | Fisher | 137/71 |
| 4,390,061 | 6/1983 | Short | 166/53 |
| 4,470,464 | 9/1984 | Baldenko et al. | 166/325 |
| 4,519,457 | 5/1985 | Holland et al. | 166/317 |
| 4,691,777 | 9/1987 | Williamson | 166/319 |
| 4,700,783 | 10/1987 | Baron | 166/372 |

*Primary Examiner*—William P. Neuder
*Attorney, Agent, or Firm*—C. Milton Fick

[57] ABSTRACT

A standing valve assembly providing a large cross-sectional flow area to reduce flow restrictions while in a production mode. A preferred embodiment of the valve is capable of movement in a valve alignment guide from a normally biased open position. The normally biased open position provides a large flow area. When removal of accumulated fluid in a wellbore is required, gas-lift gas closes the valve to isolate the producing formation allowing the fluid to be lifted from the wellbore. After removal of the fluid is completed and the gas-lift is stopped, the valve returns to its normal open position to allow flow through the valve assembly.

16 Claims, 3 Drawing Sheets

STANDING VALVE

FIELD OF INVENTION

The present invention relates generally to the production of natural gas and wellbore fluids from a subsurface formation. More specifically, this invention concerns increasing gas production rates from low pressure formations by reducing flow restrictions associated with downhole valve arrangements typically used to remove wellbore fluids.

BACKGROUND OF INVENTION

During production of natural gas from a subsurface gas reservoir, formation pressure of the reservoir decreases as gas is produced from the reservoir. This decreasing formation pressure results in reduced gas production rates from the formation. Despite such reducted production rates, low pressure gas reservoirs can continue to produce significant volumes of gas over long periods of time, even at extremely low pressures.

In order to maximize production rates and ultimate recovery volumes from a low pressure gas reservoir, it is necessary to remove any flow restrictions which might limit gas production. The need to remove such flow restrictions is important in high pressure gas reservoirs, but it is especially critical in producing low pressure gas reservoirs. The removal of flow restrictions from a well producing a low pressure gas formation will help ensure that all producible gas is removed from the formation before gas production operations are ended and the formation is abandoned.

One of the most typical flow restrictions in a low pressure gas well is caused by fluid accumulation in the wellbore. During production of a gas well, condensate, brine, or other wellbore fluids may enter and accumulate in the wellbore. Hydrostatic pressure created by the accumulated fluid reduces gas flow into the wellbore and accordingly, the gas production rate from the well. Although the well may produce some gas capable of moving through the accumulated fluid, the production rate of the well will be reduced when fluid accumulates in the wellbore. If the well cannot produce any gas capable of moving through the accumulated fluid, the gas production will completely cease. In order to remove this occasional accumulation of fluid, artificial lift means, such as gas-lift, are used to move the produced fluid to the ground surface.

During completion of a typical oil or gas well, production casing is extended from the ground surface through the reservoir to be produced. Inside the production casing is a string of pipe called production tubing. An opening called an annulus is formed between the production tubing and casing. By injecting pressurized gas into the annulus and through a downhole valve arrangement, fluids may be lifted up the production tubing to the ground surface for separation and further treating. This fluid lifting is accomplished by the injected gas expanding downhole. As the injected gas moves through the accumulated fluids, the gas expands, lightening the fluid, which helps the fluids move up the production tubing to surface. This use of pressurized gas to remove wellbore fluids in this manner is referred to as gas-lift.

Although gas-lift operations are typically used to lift fluids from oil wells, gas wells producing from low pressure formations can also use a form of gas-lift to remove produced fluids which have accumulated in a wellbore. The present invention is most useful in the removal of such accumulated fluids from a wellbore producing a low pressure gas formation.

In gas-lift operations, the gas that is injected into the production casing is occasionally higher pressure than the formation from which gas is being produced. It is, therefore, necessary to prevent the high pressure gas-lift gas from moving from the production casing into the producing formation. To keep the lift gas from being injected into the formation, a valve, typically in the form of a check valve, is placed near the end of the production tubing string. This check valve, which is also called a standing valve, is designed to allow formation gas and fluid to flow from the producing formation into the tubing when no gas-lift gas is present. When gas-lift gas is injected to assist fluid production through the production tubing, the increased production tubing pressure closes the standing valve to keep the higher pressure gas-lift gas from going into the formation. When gas-lift assistance is no longer necessary, the standing valve is again opened to allow formation gas and fluid to enter into the tubing. Standing valves are widely known and used throughout the oil and gas industry.

Although there are various commercial standing valves available, the typical standing valve severely restricts formation gas and fluid to flow into the tubing from low pressure formations when the valve is opened.

A typical standing valve is composed of a floating ball in a tapered seat arrangement. During operatin of the valve, the floating ball rests on the seat until gas or other fluid is produced from the formation into the tubing. As the fluid flows up the tubing past the standing valve, the fluid lifts the ball off its tapered, sealing seat allowing fluid to enter the production tubing. When fluid has accumulated such that pressure created by the fluid accumulated above the standing valve is equal to the subsurface reservoir pressure, the floating ball valve will rest on the seat and not allow gas or other fluid in the tubing to move up or down through the ball valve seat. At this point, gas is injected into the annulus to remove the fluid that has accumulated above the standing valve.

After the accumulated fluid has been removed, injection of gas-lift gas is discontinued. The floating ball then moves off the seat and the standing valve again allows gas and other fluids into the tubing.

The standard ball and seat type standing valve requires that the produced gas and fluids lift the ball off the seat and move across the ball and valve seat. This flow path past the seat and ball significantly increases pressure drop through the valve and reduces gas production rates. For wells producing high pressure formations, the pressure drop across a standing valve may be acceptable due to other flow restrictions in a producing well. However, for wells producing low pressure formations, the continuous drop across the valve, which may be on the order of 10 pounds per square inch, causes flow restrictions that significantly reduce the production rate of a given well.

The need exists for a standing valve which has less restrictive flow paths to reduce the significant pressure drop experienced through normal standing valves. The present invention accomplishes this through a valve seating device and seating arrangement which provides a large cross-sectional flow area when the valve seating device is not in contact with the seating arrangement.

This large cross-sectinal area allows large gas volumes to move through a standing valve arrangement and experience significantly less pressure drop than when the same gas volumes move through a standard ball and seat valve.

SUMMARY OF INVENTION

The present invention is directed to a standing valve having a large, cross-sectional flow area which significantly reduces pressure drop through the valve. A standing valve of the present invention comprises a valve housing fixedly secured to a wellbore tubing string and having a plurality of perforations, a valve seating surface, a valve alignment guide, a valve stem adapted for movement in the valve alignment guide and a valve seating device capable of contacting the valve seating surface.

The standing valve of the present inventin, especially useful in wellbores producing from low pressure gas formations, allows fluid to flow freely past the valve seating surface and accumulate in the wellbore.

When removal of fluid from a wellbore is required, gas-lift gas is injected into the well. The gas-lift gas moves the valve seating device against the valve seating surface to isolate the producing formation from the injected gas-lift. The injected gas lift may then be used to lift the accumulated fluid from the wellbore. After the fluid is removed and gas-lift injection is stopped, the valve seating device will move away from the seating surface and allow gas to be produced.

One preferred embodiment of the present invention additionally includes a means for biasing the valve seating device above the valve seating surface. The injected gas-lift will offset the biasing means to cause the valve seating device to move to the sealing seat, thereby allowing removal of the accumulated fluid from the wellbore. Discontinuation of the gas lift allows the valve seating device to be removed from the sealing seat to allow maximum flow through the standing valve.

The standing valve of the present invention may also be made retrievable through the use of a standard wireline cable with a locking mandrel and a landing nipple. The standing valve may be retrieved from the wellbore for repair, adjustment, or replacement.

BRIEF DESCRIPTION OF THE DRAWINGS

For a better understanding of the present invention, references may be had to the drawings, in which.

These drawings are not intended in any way to limit the present invention, but are provided solely for the purposes of illustrating certain preferred embodiments and applications of the present invention.

DESCRIPTION OF THE PREFERRED EMBODIMENTS

The present inventin is a standing valve assembly useful for removing fluid accumulations in a wellbore. Use of a seating device and sealing seat arrangement to increase the cross sectional flow area of the valve reduces pressure drop through the valve assembly during production of natural gas, thereby increasing the rate of flow through the valve.

During operation, the valve seating device is biased above a sealing seat to create a large flow area which minimizes gas pressure drop through the valve. During removal of accumulated fluids from the wellbore, the valve will be operated by gas-lift pressure to isolate the formation from the increased gas-lift pressure and assist in the removal of fluid from the wellbore. After the fluid removal is completed, the valve seating device will return to a normal, biased open position above the sealing seat.

Figure 1:
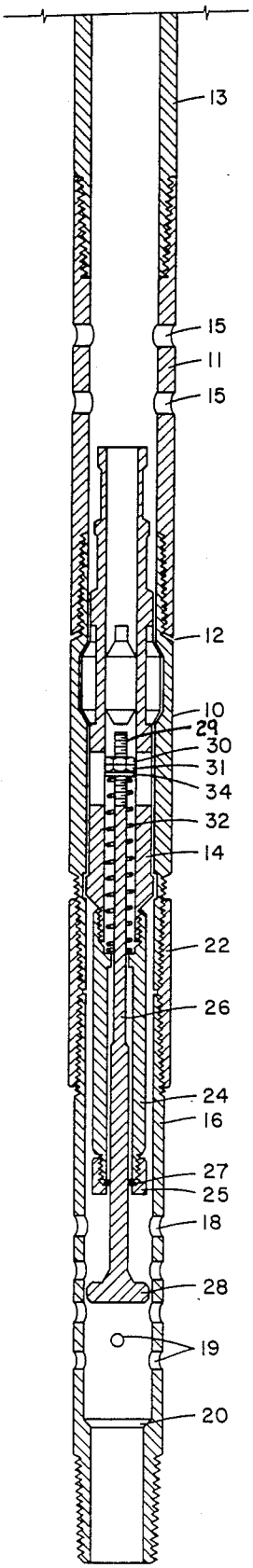
FIG. 1 shows a side view, in section, of a preferred embodiment of the apparatus of this invention.

FIG. 1 shows a side view, in section, of a preferred embodiment of the present invention. In FIG. 1, standing valve assembly 10 is attached to production tubing 13. Included in standing valve assembly 10 are threaded perforated nipple 11, threaded landing nipple 12, and locking mandrel 14. Landing nipple 12 and locking mandrel 14, such as shown in FIG. 1, are devices used in the oil and gas industry to install and retrieve downhole tools using a standard wireline cable. In conjunction with a landing nipple and locking mandrel arrangement, a wireline cable may be lowered down a wellbore and attached to the locking mandrel for retrieval of the locking mandrel and any attached downhole device. When using such an arrangement, it is not necessary to remove production tubing string 13 to repair or replace the downhole tool or in the present case, certain portions of standing valve assembly 10.

Perforated nipple 11 is a short tubular nipple with threaded end connections. Nipple 11 has perforations 15 which allow fluids to move in and out of nipple 11. Landing nipple 12 is a short tubular nipple that has an internally machined profile capable of receiving a downhole device and locking such device into a desired position. Landing nipple 12 is attached to perforated nipple 11 which is attached to tubing string 13. Perforated nipple 11 and landing nipple 12 are placed in a specific location when the tubing is installed.

Locking mandrel 14 is a downhole device capable of attaching to various subsurface tools and being lowered by wireline units with such tools into production tubing 13. When locking mandrel 14 and the attached tool enter landing nipple 12, locking mandrel 14 will automatically secure itself into landing nipple 12. Locking mandrel 14 typically has a set of spring loaded keys which extend and lock the mandrel in place in landing nipple 12. In the present invention, landing nipple 12 is capable of receiving locking mandrel 14.

There are several types of wireline retrievable tool arrangements that are capable of being used in place of locking mandrel 14 and landing nipple 12. One alternate type tool available is a seating mandrel and polished nipple which would replace the locking mandrel and landing nipple described above. A seating mandrel would use wedges to secure itself and the attached valve assembly in the polished nipple rather than spring loaded keys as used in a locking mandrel. Other similar downhole retrievable devices could also be used in connection with the present invention.

Attached to landing nipple 12 by collar 22 is perforated valve seating nipple 16. A collar is shown here to connect landing nipple 12 and seating nipple 16 because it is a convenient way to assemble and disassemble valve assembly 10. However, as discussed later, landing nipple 12 and seating nipple 16 may be fabricated from a single piece of material and therefore not require collar 22 as shown in FIG. 1. Also, seating nipple 16 may be fabricated with an integral collar capable of receiving landing nipple 12.

Perforated valve seating nipple 16 is a short section of pipe that has perforations 18 and 19 above tapered valve seat 20. Tapered valve seat 20 provides a sealing surface required to isolate the producing formation from the high pressure lift gas used to lift fluid from the wellbore. Although valve seat 20 is shown as a machined part of seating nipple 16, a replaceable seating surface could also be set in seating nipple 16. This replaceable seating surface could be attached to seating nipple 16 and replaced when wear or damage prevents a positive seal at seat 20. As seen in FIG. 1, a large cross-sectional flow area is provided by valve seat 20 of the present embodiment which reduces flow restrictions during gas production.

Inside of landing nipple 12 and seating nipple 16, attached to locking mandrel 14, is valve stem alignment guide 24. In the preferred embodiment, valve stem alignment guide 24 is of standard bored carbon steel or stainless steel bar stock material, with threaded end connections. The upper threaded connection of alignment guide 24 connects to locking mandrel 14. At the base of alignment guide 24 is valve stem guide packing cap 25, which is also threaded and is capable of attaching to alignment guide 24. Valve stem guide packing cap 25 using O-ring 27 to seal and protect valve stem 26 and the bore of alignment guide 24 from foreign particulate matter produced with the reservoir fluids.

As previously mentioned, alignment guide 24 is of bored bar stock, which allows threaded valve stem 26 to be inserted through the bore and up into locking mandrel 14. Threaded valve stem 26 has at one end, a seating device 28 fitted for contact with valve seat 20. When seating device 28 contacts valve seat 20, gas or fluid movement across valve seat 20 and seating device 28 and through valve assembly 10 is prevented. In the preferred embodiment, threaded valve stem 26 and seating device 28 are of standard carbon steel or stainless steel material. Threaded valve stem 26 and seating device 28 may be threaded or otherwise fastened together to insure they do not separate during valve operation. Threaded valve stem 26 and seating device 28 may also be forged or machined from a single piece of material. Although seating device 28 is shown herein as a flat, tapered disk plate, it is understood that seating device 28 may also have a spherical shape or any other shape capable of sealing against seat 20.

At the opposing end of valve stem 26 from seating device 28 ia threaded section 29, which is capable of receiving valve positioning lock nuts 30 and 31. Below lock nuts 30 and 31 is valve stem spring 32. Spring 32 is mounted around valve steam 26 and contacts valve stem alignment guide 24 at its lower end and spring retaining washer 34 at its upper end. Spring retaining washer 34 is used to prevent spring 32 from moving past valve positioning lock nuts 30 and 31. Lock nuts 30 and 31 also allow adjustment of valve stem 36 and seating device 28 above valve seat 20.

Threaded valve stem 26 is capable of moving up and down through locking mandrel 14 and alignment guide 24. During normal operation, valve stem spring 32 holds threaded valve stem 26 and seating device 28 in an open position above valve seat 20. When wellbore fluid removal is necessary, seating device 28 moves down to contact valve seat 20. Alignment guide 24 maintains proper alignment of valve stem 26 and seating device 28 as seating device 28 moves down to contact valve seat 20. As valve stem 26 and seating device 28 move downward, valve stem spring 32 is compressed between spring retaining washer 34 and alignment guide 24.

Tension requirements of spring 32 depend on several factors, including the weight of valve stem 26 and seating device 28, the height of seating device 28 above valve seat 20, and the pressure of the producing formation. Spring 32 should be capable of holding valve stem 26 and seating device 28 above valve seat 20, but should also allow downward movement of seating device 28 to seat 20 when high pressure gas exerts a force on the top of seating device 28 and valve positioning nuts 30 and 31. Since spring 32 will be exposed to various formation fluids and possible well stimulation fluids, it is desirable that spring 32 be made out of a corrosion resistant material such as stainless steel.

Although a means to bias the valve stem and valve seating device above the valve seat, such as a spring, is suggested, a standing valve as disclosed herein may be operative without such means to keep the valve stem and valve seating device above the valve seat. A standing valve without such biasing means would require that the gas pressure from the formation to move seating device 28 away from seat 20 to allow gas to move through the standing valve assembly. Although this would result in a slight flow restriction through the valve, a very large cross-sectional flow area would be provided, still resulting in an efficient standing valve assembly.

FIG. 2 shows standing valve assembly 10 installed in wellbore 50 inside of production casing 52. Production casing 52 extends through gas producing formation 56. Certain items shown in FIG. 1, such as the locking mandrel and landing nipple, are omitted from FIG. 2 for clarity.

Standing valve assembly 10 is attached to production tubing 13 at one end and secured to production casing 52 at the other end by packer 54. Packer 54 is a mechanical device used to create a seal between production casing 52 and production tubing 13 to prevent gas or fluid flow from a producing formation into production casing 52. Packers used with the present invention as shown in FIG. 2 are well known and commercially available throughout the oil industry.

FIG. 2 also shows annulus 62 formed between production tubing 13 and production casing 52. The remaining items in FIG. 2 correspond to the respective items shown in FIG. 1.

Figure 2A:
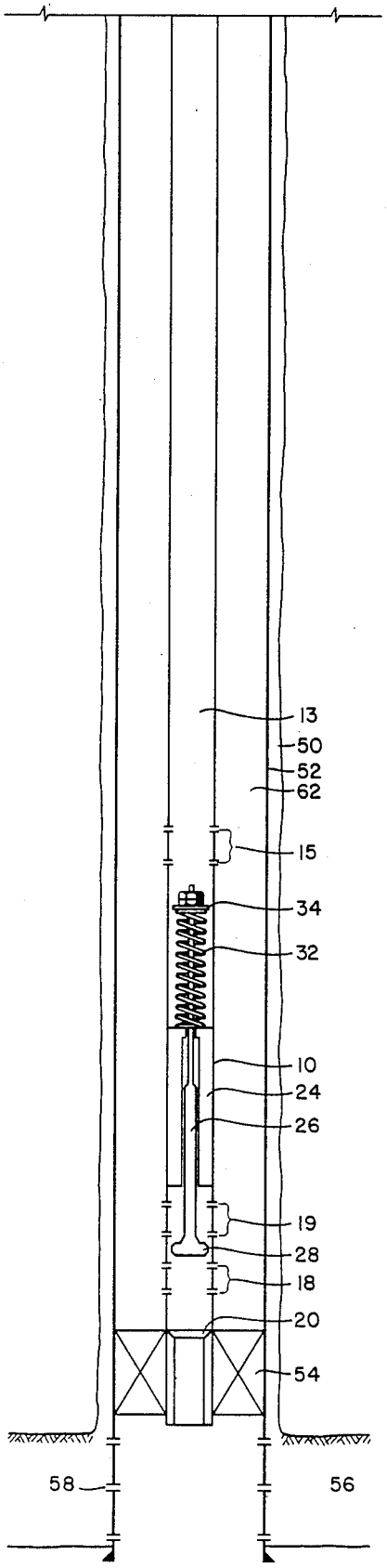
FIGS. 2A and 2B show operations of a preferred embodiment of the apparatus of this invention in a wellbore.
Figure 2B:
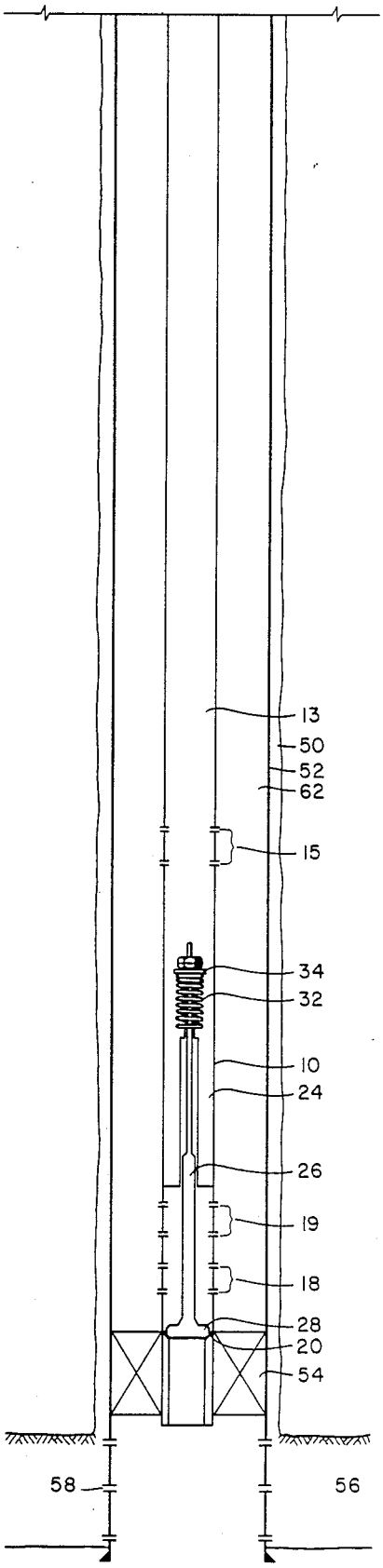

FIG. 2A shows standing valve assembly in a gas producing mode, while FIG. 2B shows standing valve assembly 10 in a fluid removal mode. In FIG. 2B, seating device 28 has moved into contact with valve seat 20 to isolate producing formation 56 from production tubing 13. With standing valve assembly 10 in this position, accumulated wellbore fluids may be removed from the production tubing 13 and production casing 52.

IN OPERATION

The operation of standing valve assembly 10 as installed in a low pressure gas well will now be discussed with reference to FIG. 1 and FIG. 2.

During production from a low pressure gas well, gas is produced from formation 56 through perforations 58 into production casing 52. The produced gas enters standing valve assembly 10 below packer 54. The produced gas then moves up through standing valve assembly 10 through perforations 18 below seating device 28 and into production casing 52. The gas then flows into producing casing 52 and up annulus 62 between production casing 52 and production tubing 13. After the gas has moved past standing valve assembly 10, some of the gas may move back into production tubing 13 through perforations 15. The gas is then produced to the surface through production tubing 13 and production casing 52. The gas is then collected and gathered for handling and treating from production casing 52 and production tubing 13. By using both production tubing 13 and production casing 52 to produce gas, a larger flow area is provided, which reduces flow restrictions and increases the rate of gas production.

As stated earlier, during its gas production mode, a standing valve assembly as described herein minimizes the pressure drop experienced by the gas as it moves through the valve assembly. This is accomplished by the large cross-sectional flow area obtained by the seating and disk arrangement having a nearly full-open port in the bottom of the seating nipple. By having seat 20 remain in the wellbore during removal of the locking mandrel and valve guide and valve stem and disk arrangement, a maximum seat flow area is achieved. This compares to other wireline retrievable floating ball type valves, which, because the entire valve, including the seating surface is retrieved, the entire valve must be small enough to be lowered into and raised out of the tubing. Because of such a size restriction, standard wireline retrievable floating ball type cannot obtain the large cross-sectional flow area as achieved with a standing valve of the present invention.

Also, because floating ball type standing valves require a constant upward force to lift the ball off the seat to open a flow passage, flow is always restricted. In a preferred embodiment of the present invention, during gas production, seating device 28 is off seat 20, thereby not restricting flow across the seat.

Since the gas flow moves through seat 20 and on through perforations 18, it is desirable to have the cross-sectional flow area provided by perforations 18 below seating device 28 be at least equal to the cross-sectional flow area provided across valve seat 20. By providing such flow areas, it ensures that gas flow through perforation 18 does not add any significant gas flow restrictions as the gas moves through standing valve assembly 10 into production casing 52.

As previously mentioned, during the production of a gas well, fluids such as condensate or brine may enter the production tubing 13 and production casing 52. As these wellbore fluids accumulate, hydrostatic pressure is exerted by these fluids on the producing formation. This hydrostatic pressure reduces the pressure differential between the producing formation and the pressure in the wellbore. This reduced pressure differential reduces gas flow into production tubing 13 for production through tubing 13 and casing 52.

In order to remove this accumulated fluid, high pressure gas (gas-lift gas) is introduced into annulus 62 between production casing 52 and production tubing 13. Gas-lift gas on the order of six hundred to one thousand pounds per square inch gauge is typically used. As the gas moves down annulus 62, it forces the accumulated fluids around standing valve assembly 10 through perforations 19 above seating device 28. The fluid moving downward exerts a force against the top of seating device 28. The force exerted by the fluids on the top of seating device 28 moves seating device 28 down, overcoming the upward force exerted by valve stem spring 32. The movement of valve stem 26 and seating device 28 in valve stem guide 24 continues until seating device 28 seats on valve seat 20. The resulting positions of valve stem 26 and seating device 28 are shown in FIG. 2B. The seating between seating device 28 and valve seat 20 prevents fluids or gas from moving from the production casing through standing valve assembly 10 into producing formation 56.

The high pressure gas then moves the accumulated fluids into production tubing 13 through perforations 15. As this high pressure gas expands and moves into production tubing 13, liquid particle transport mechanics of the expanding gas move the fluid up production tubing 13 in slugs and small droplets and out the wellbore. Gas-lift gas is continuously introduced at a rate high enough to carry the remaining fluid to the surface until all fluid above perforations 15 is removed. In addition to preventing gas from moving from the production casing into formation 56 while seating device 28 contacts seat 20, standing valve assembly 10 prevents formation 56 from producing gas during removal of the accumulated fluids in the wellbore.

During removal of the accumulated fluids, high pressure gas-lift gas introduced into casing 52 will attempt to force some of the accumulated fluid past seat 20 and into producing formation 56 before seating device 28 can contact seat 20 to isolate the formation. Increasing the size and number of perforations 19 above seating device 28 will allow fluid to move into valve assembly 10 through perforations 19 above seating device 28 more quickly, thereby allowing seating device 28 to move downward to seat 20 more rapidly. By having perforations 19 above seating device 28 slightly larger and more numerous than perforations 18 below seating device 28, seating device 28 will move more easily and quickly to contact valve seat 20.

After the accumulated fluids have been removed, the gas-lift is stopped. The pressurized gas-lift gas in the annulus moves up the production tubing into the gathering system at the ground surface. After the pressure is reduced to a point such that the upward force exerted by producing formation 56 and stem spring 32 is greater than the downward forces exerted by the injected gas on the top of valve seating device 28, valve seating device 28 is lifted off seat 20. The flow of gas then begins again, with valve stem 26 and seating device 28 moving back to the position shown in FIG. 2A. Gas is again produced until accumulated fluids reduce production of gas to a point that requires their removal of the produced fluids. With valve seating device 28 normally off sealing seat 20, a maximum seat cross section flow area is provided by the standing valve.

The introduction of gas-lift into a wellbore to remove accumulated fluid may be controlled manually. Also, because fluid production from a low pressure gas well may be constant over a period of time, an automatic control device may be used to intermittently inject gas-lift gas into the wellbore. Various types of intermittent injection devices and arrangements are commercially available to control injection of gas-lift gas.

Figure 3:
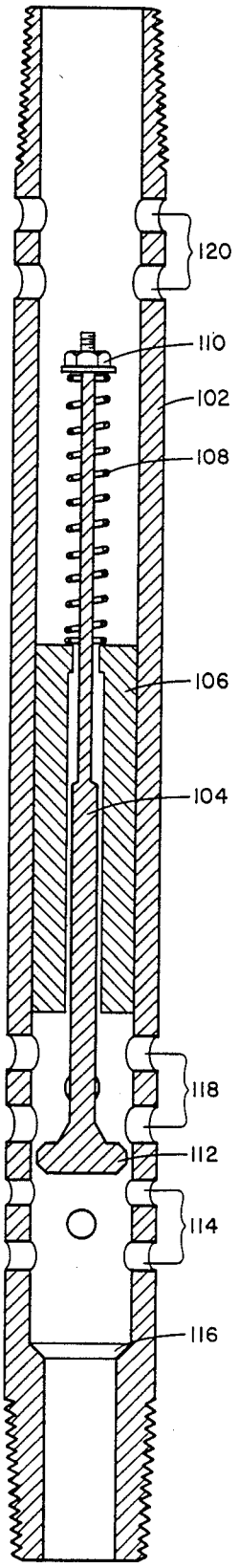
FIG. 3 shows a side view, in section, of another preferred embodiment of the apparatus of this invention.

The preferred embodiment of the present invention, as shown in FIG. 1, allows for the retrieval of standing valve assembly 10 through the use of a standard wireline cable arrangement. However, FIG. 1 includes several items that are not mandatory for use of the present invention. FIG. 3 shows a simplified standing valve assembly containing valve housing 102, valve stem 104, valve stem alignment guide 106, spring 108, adjustment and locking nut 110, seating device 112, perforations 114, 118, 120, and sealing seat 116. Guide 106 could be secured to valve housing 102 through fastening mean such as welding or screw fittings (not shown).

The embodiment shown in FIG. 3 may be installed at the end of a production tubing string and immediately above a packer in a wellbore. Because the embodiment shown in FIG. 3 is not wireline retrievable, it would be necessary to pull the production tubing string to repair or replace any components of the standing valve assembly. The operation of the valve shown in FIG. 3 is similar to the operation of that shown in FIGS. 1 and 2. Produced gas and produced fluids pass up through sealing seat 116 at the lower section of standing valve assembly housing 102. Fluid and gas then enter production casing through perforations 114 below seating device 112. When removal of accumulated fluid is required, gas is injected down the casing forcing fluid though perforations 118 above seating device 112, to exert a downward force on seating device 112. This downward force overcomes the upward force exerted by spring 108 and moves seating device 112 into contact with sealing seat 116. Fluids are then moved up the production tubing for removal, after which gas injection is discontinued. Seating device 112 then moves away from sealing seat 116 to its normal position.

As mentioned above, it would be possible for the valve to operate without a spring or other means to bias the valve stem and seating device away from the seating surface. Without such biasing means, the valve seating device would rest on the seating surface until produced gas would move the seating device away from the seat, opening a flow passage through the valve. When fluid removal was necessary, the seating device would already be in contact with the seating surface to isolate the formation from the gas-lift gas.

It will be apparent to those skilled in art that various changes may be made in the details of construction of the apparatus as disclosed herein without departing from the spirit and scope of the invention. Such changes in details are included within the scope of this invention as defined in the following claims.

What I claim is:

1. An apparatus for removing fluids from a wellbore comprising:
- a valve housing fixedly secured to a wellbore tubing string, said housing having a plurality of perforations and a valve seating surface;
- a valve stem alignment guide secured to the valve housing;
- a valve stem adapted for movement in the valve stem alignment guide; and
- a valve seating device attached to the valve stem and capable of contacting the valve seating surface, thereby preventing fluid flow through the valve housing and past the valve seating surface when the seating device and valve seating surface are in contact.

2. The apparatus of claim 1 further comprising a means for biasing the valve seating device above the valve seating surface.

3. The apparatus of claim 2 wherein the means for biasing the valve seating device above the valve seating surface is a spring.

4. The apparatus of claim 3 wherein the valve stem is threaded to allow adjustment of the valve above the valve seating surface.

5. An apparatus for removing fluids from a wellbore comprising:
- a valve housing fixedly secured to a wellbore tubing string, said housing having a plurality of perforations;
- a valve stem alignment guide secured to the valve housing;
- a valve stem adopted for movement in the valve stem alignment guide;
- a valve seating device attached to the valve stem;
- a valve seat attached to the housing capable of receiving the valve seating device, thereby preventing fluid flow through the valve housing and past the valve seat when the valve seating device and valve seat are in contact.

6. The apparatus of claim 5 further comprising a means for biasing the valve seating device above the valve seat.

7. The apparatus of claim 6 wherein the means for biasing the valve seating device above the valve seat is a spring.

8. The apparatus of claim 7 wherein the valve stem is threaded to allow adjustment of the valve above the valve seat.

9. An apparatus for removing fluids from a wellbore comprising:
- a first perforated nipple;
- a locking mandrel;
- a landing nipple attached to the first perforated nipple at a first end, said landing nipple having an internal profile adapted to received the locking mandrel;
- a second perforated nipple attached to a second end of the landing nipple and having a seating surface;
- a valve stem alignment guide attached to the locking mandrel;
- a valve stem adapted for movement in the valve stem alignment guide;
- a valve seating device attached to the valve stem and adapted to contact the seating surface of the second perforated nipple, thereby preventing fluid flow through the second perforated nipple and past the seating surface of the second perforated nipple when the seating device and seating surface are in contact, wherein the locking mandrel, the valve alignment guide, the valve stem and the valve seating device are retrievable from the wellbore through use of a wireline cable.

10. The apparatus of claim 9 further comprising means for biasing the valve seating device above the seating surface of the second perforated nipple.

11. The apparatus of claim 10, wherein the means for biasing the valve seating device above the seating surface of the second perforated nipple is a spring.

12. The apparatus of claim 11 wherein the valve stem is threaded, whereby allowing adjustment of the valve above the seating surface.

13. An apparatus for removing fluids from a wellbore comprising:
- a first perforated nipple;
- locking mandrel;
- a landing nipple attached to the first perforated nipple having an internal profile adapted to receive the locking mandrel;
- a second perforated nipple attached to the opposing end of the landing nipple;
- a valve stem alignment guide attached to the locking mandrel;
- a valve stem adapted for movement in the valve stem alignment guide;

a valve seating device attached to the valve stem and capable of movement with the valve stem;

a valve seat attached to the second perforated nipple capable of receiving the valve seating device, thereby preventing fluid flow through the second, perforated nipple and past the valve seat when the seating device and valve seat surface are in contact, wherein the locking mandrel, the valve alignment guide, the valve stem and valve seating device are retrievable from the wellbore through use of the wireline cable.

14. The apparatus of claim 13 further comprising means for biasing the valve seating device above the valve seat attached to the second perforated nipple.

15. The apparatus of claim 14, wherein the means for biasing the valve seating device above the valve seat is a spring.

16. The apparatus of claim 15, wherein the valve stem is threaded, whereby allowing adjustment of the valve above the valve seat.

* * * * *